US010190531B2

(12) United States Patent
Jang

(10) Patent No.: US 10,190,531 B2
(45) Date of Patent: Jan. 29, 2019

(54) WATER JACKET FOR A CYLINDER HEAD

(71) Applicants: HYUNDAI MOTOR COMPANY, Seoul (KR); KIA MOTORS CORPORATION, Seoul (KR)

(72) Inventor: Sung Kweon Jang, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 82 days.

(21) Appl. No.: 15/377,391

(22) Filed: Dec. 13, 2016

(65) Prior Publication Data

US 2018/0100463 A1 Apr. 12, 2018

(30) Foreign Application Priority Data

Oct. 10, 2016 (KR) ..... 10-2016-0130465

(51) Int. Cl.

| | |
|---|---|
| ***F02F 1/40*** | (2006.01) |
| ***F01P 3/02*** | (2006.01) |
| ***F02F 1/24*** | (2006.01) |
| ***F02F 1/42*** | (2006.01) |

(52) U.S. Cl.

CPC ..... *F02F 1/40* (2013.01); *F01P 3/02* (2013.01); *F02F 1/242* (2013.01); *F02F 1/243* (2013.01); *F02F 1/4285* (2013.01); *F01P 2003/024* (2013.01)

(58) Field of Classification Search

CPC .. F02F 1/40; F02F 1/242; F02F 1/4285; F01P 3/02; F01P 2003/024

USPC ..... 123/41.82 R, 41.72, 41.79

See application file for complete search history.

(56) References Cited

U.S. PATENT DOCUMENTS

| | | | | |
|---|---|---|---|---|
| 4,569,313 | A * | 2/1986 | Nobu | F01P 3/02 123/41.74 |
| 6,973,897 | B2 | 12/2005 | Haubner | |
| 2002/0170510 | A1* | 11/2002 | Iizuka | F01P 7/16 123/41.84 |
| 2005/0145205 | A1 | 7/2005 | Haubner | |
| 2009/0301414 | A1* | 12/2009 | Netsu | F01M 5/00 123/41.72 |
| 2016/0102595 | A1* | 4/2016 | Nagai | F02M 35/10091 123/41.82 R |

FOREIGN PATENT DOCUMENTS

| | | |
|---|---|---|
| JP | 2001050106 | 2/2001 |
| JP | 2005535819 | 11/2005 |
| KR | 1020140078437 A | 6/2014 |

OTHER PUBLICATIONS

KR Office Action dated Feb. 14, 2018, Office Action cited in the corresponding Korean Patent Application No. 10-2016-0130465; dated Feb. 14, 2018; 6 pages.

* cited by examiner

*Primary Examiner* — Syed O Hasan

(74) *Attorney, Agent, or Firm* — Lempia Summerfield Katz LLC

(57) ABSTRACT

Disclosed is a water jacket for a cylinder head. The disclosed water jacket allows a coolant flowing in a cylinder head to pass around exhaust ports, thereby cooling the cylinder head to equalize the temperature thereof. The disclosed water jacket includes a coolant inlet provided around exhaust port holes of a cylinder head to concentrate a flow of a coolant to the coolant inlet and a coolant passage configured to allow the coolant flowing in through the coolant inlet to flow around the exhaust port holes.

9 Claims, 3 Drawing Sheets

WATER JACKET FOR A CYLINDER HEAD

CROSS REFERENCE TO RELATED APPLICATION

The present application claims priority to and benefit of Korean Patent Application No. 10-2016-0130465, filed Oct. 10, 2016, the entire contents of which is incorporated herein for all purposes by this reference.

BACKGROUND

Field of the Disclosure

The present disclosure relates to a water jacket for a cylinder head of an engine.

Description of the Related Art

Generally, when an engine is driven, the engine temperature dramatically rises by combustion of the fuel/air mixture. To maintain an appropriate engine operating temperature by cooling the engine, a water jacket, a space for allowing a coolant to flow through and circulate, is provided in a cylinder block and a cylinder head.

In other words, the coolant circulates in the following manner. The coolant, which has absorbed heat from the engine while circulating through the water jacket, is processed by heat exchange when the coolant flows through a radiator. The coolant then flows back to the water jacket from the radiator and cools the cylinder block and cylinder head. After that, the coolant flows back to the radiator.

However, conventional water jackets of cylinder heads are provided with coolant inlets that are separated from each other.

In other words, since a flow path of the coolant flowing in the water jacket is divided and formed at many locations, it is difficult to induce the coolant to be focused on a predetermined area. Also, the flow velocity of the coolant is decreased and the temperature of the coolant rises rapidly.

Accordingly, hot spots produced by a local increase in temperature of the exhaust ports of the cylinder head may occur. As a result, knocking often occurs at the hot spot and fuel efficiency is lowered by combustion instability.

The foregoing is intended merely to aid in the understanding of the background of the present disclosure. It is not intended to mean that the present disclosure falls within the purview of the prior art that is already known to those of ordinary skill in the art.

SUMMARY

The present disclosure is directed to a water jacket for a cylinder head. The disclosed water jacket allows a coolant flowing in a cylinder head to pass around exhaust ports, thereby cooling the cylinder head to equalize the temperature thereof.

According to one embodiment of the present disclosure, a water jacket for a cylinder head includes: a coolant inlet provided around exhaust port holes of a cylinder head to concentrate a flow of a coolant to the coolant inlet; and a coolant passage configured to allow the coolant flowing in through the coolant inlet to flow around the exhaust port holes.

In one embodiment of the present disclosure, the disclosed water jacket may further include: a first partition wall provided between exhaust port holes of a cylinder and neighboring exhaust port holes of a neighboring cylinder; a second partition wall provided between intake port holes of the cylinder and neighboring intake port holes of the neighboring cylinder; and a passageway communicating with the coolant passage, the passageway provided between an end portion of the first partition wall and an end portion of the second partition wall such that the coolant flows through the passageway.

In one embodiment of the present disclosure, the coolant passage may include a first passage configured to allow the coolant having flowed in through the coolant inlet to flow around end portions of the exhaust port holes. The end portions of the exhaust port holes may be configured to connect to a combustion chamber.

The first passage may be configured to branch from the coolant inlet to surround each of the exhaust port holes.

In one embodiment of the present disclosure, the coolant passage may further include a second passage configured to cross from an end portion of the first passage to an upper portion of the combustion chamber.

The second passage may be configured to surround a spark plug hole provided in the cylinder head.

The second passage may be configured to surround peripheries of end portions of the intake port holes. The end portions of the intake port holes may be configured to connect to the combustion chamber.

In one embodiment of the present disclosure, the coolant passage may further include: a third passage extending from the second passage to a periphery of an oil jacket provided in the cylinder head; and a coolant outlet connected to the third passage to allow the coolant to be discharged therefrom.

The third passage may be configured to branch at a location around the oil jacket. The coolant outlet may be provided at a location where the branched third passages join each other.

In one embodiment of the present disclosure, the coolant inlet may be configured to allow the coolant to flow in from a lower portion of the cylinder head. The first passage may be provided at the lower portion of the cylinder head such that the coolant flows from the coolant inlet toward the exhaust port holes. The second passage may be provided at the lower portion of the cylinder head such that the coolant flows from the exhaust port holes toward the intake port holes. The third passage may be provided at an upper portion of the cylinder head such that the coolant flows from the intake port holes toward the exhaust port holes. The coolant outlet may be configured to allow the coolant to be discharged from the upper portion of the cylinder head.

As described above, the present disclosure is configured such that all the cool coolant flowing in the water jacket of a cylinder head passes around the exhaust ports, the metal surface temperature of which is the highest of the cylinder head. The flow velocity of the coolant passing around the exhaust ports is increased and thus lowers the metal surface temperature of the exhaust ports. Accordingly, by equalizing metal surface temperatures of the combustion chamber of a cylinder head, any hot spots produced by local increases in temperature are removed, thereby improving fuel efficiency by lowering the risk of knocking.

BRIEF DESCRIPTION OF THE DRAWINGS

The above, as well as other objects, features and other advantages of the present disclosure will be more clearly understood from the detailed description below when taken in conjunction with the accompanying drawings, in which.

DETAILED DESCRIPTION OF THE EMBODIMENTS

Figure 1:
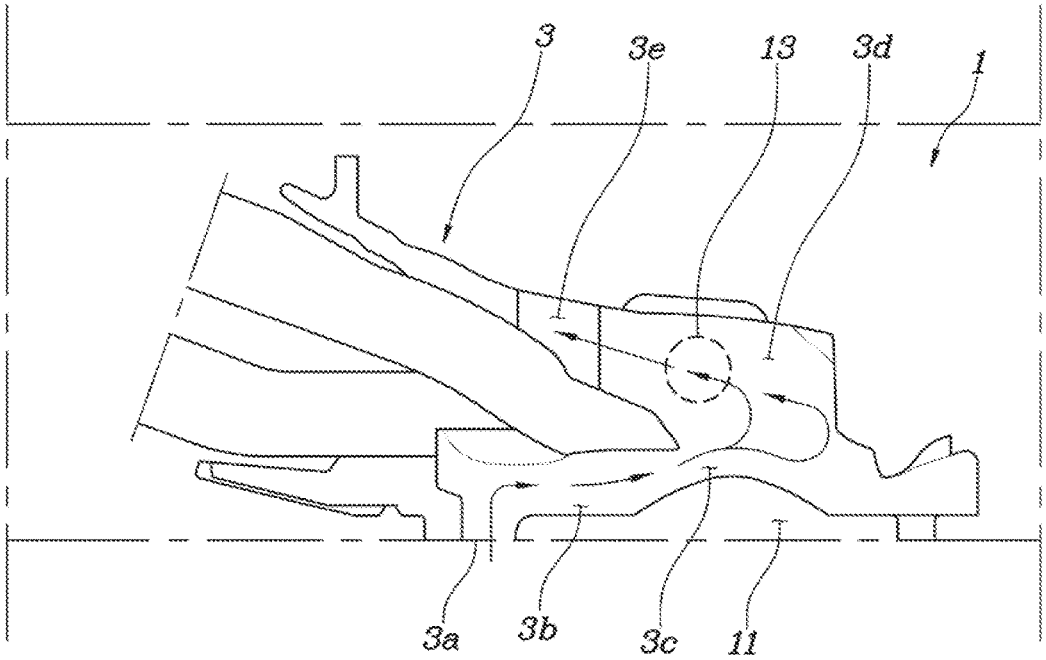
FIG. 1 is a side view of a water jacket provided in a cylinder head showing a flow of a coolant according to one embodiment of the present disclosure.

Hereinafter, embodiments of the present disclosure are described in detail with reference to the accompanying drawings. Throughout the drawings and specification, the same reference numerals will refer to the same or like parts.

A water jacket for a cylinder head according to one embodiment of the present disclosure is configured to induce a flow of a coolant to be focused on a predetermined area.

Figure 2:
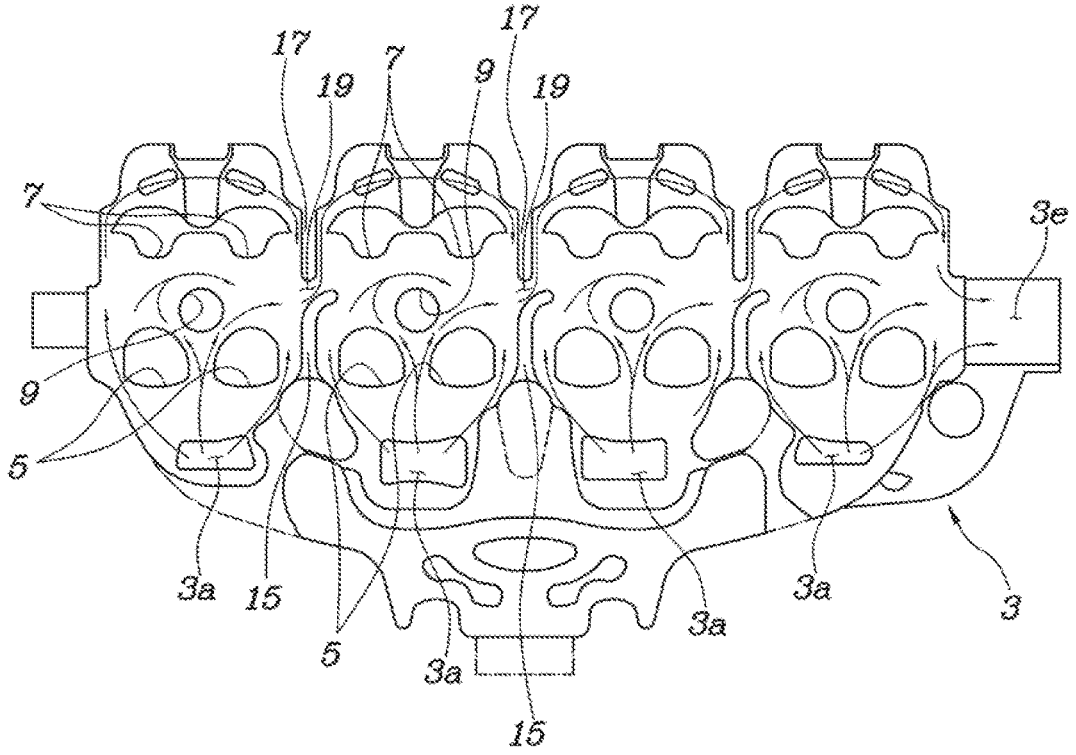
FIG. 2 is a bottom view of the water jacket of FIG. 1 showing the flow of the coolant according to one embodiment of the present disclosure.
Figure 3:
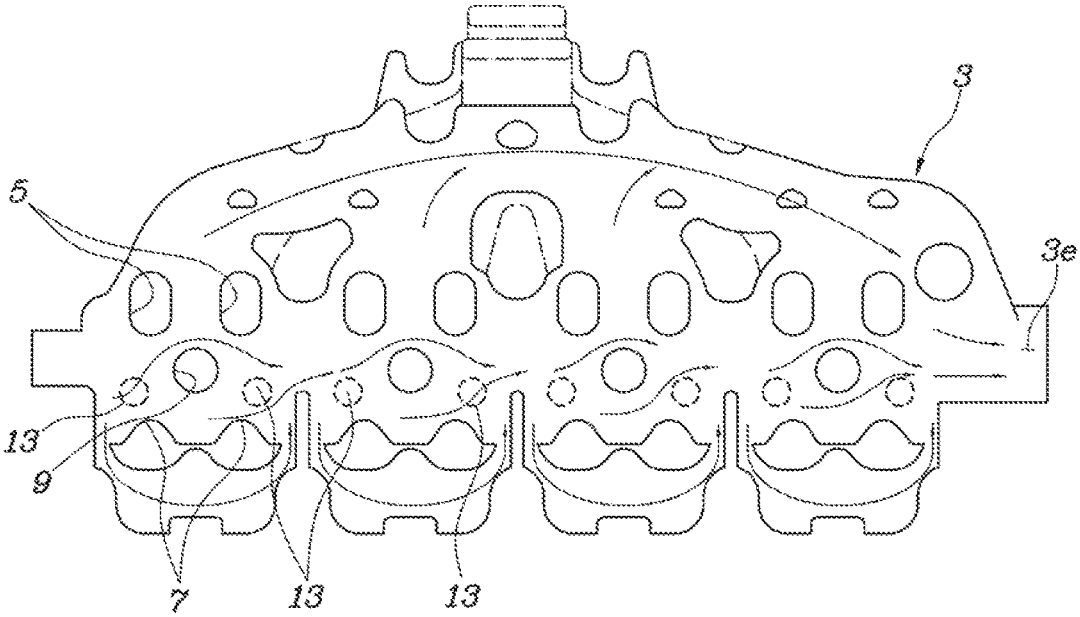
FIG. 3 is a top view of the water jacket of FIG. 1 showing the flow of the coolant according to one embodiment of the present disclosure.

Specifically referring to the present disclosure with reference to FIGS. 1-3, a water jacket 3 is disclosed according to one embodiment for allowing a coolant to flow in and through a cylinder head 1. The disclosed water jacket 3 includes a coolant passage for allowing the coolant to flow therein.

Specifically, the disclosed water jacket 3 includes at least one coolant inlet 3*a* near exhaust port holes 5 of the cylinder head 1 to concentrate the flow of the coolant to the coolant inlet 3*a*. The coolant passage is configured to allow the coolant flowing in through the coolant inlet 3*a* to flow around the exhaust port holes 5.

In other words, since all of the cool coolant flowing into the water jacket 3 of the cylinder head 1 is focused on an area around the exhaust ports that have a relatively high temperature, and flows in and passes around the area, the flow velocity of the coolant passing by the exhaust port holes 5 increases. Accordingly, the metal surface temperature of the exhaust ports is lowered, thereby improving knocking resistance and fuel efficiency.

Further, according to one embodiment, the present disclosure may be configured to include a first partition wall 15 provided between exhaust port holes 5 of a cylinder and neighboring exhaust port holes of a neighboring cylinder. The present disclosure of one embodiment may also be configured to include a second partition wall 17 provided between intake port holes 7 of the cylinder and neighboring intake port holes of the neighboring cylinder.

In this embodiment, for example, the first partition wall 15 may be provided between exhaust port holes 5 corresponding to a cylinder and exhaust port holes 5 corresponding to a neighboring cylinder. The second partition wall 17 may be provided between intake port holes 7 corresponding to the cylinder and intake port holes 7 corresponding to the neighboring cylinder.

In this embodiment, a passageway 19 communicating with the coolant passage is provided between an end portion of the first partition wall 15 and an end portion of the second partition wall 17 such that the coolant flows through the passageway 19.

In this embodiment, the first partition wall 15 and the second partition wall 17 may be provided by protruding a portion of the metal structure of the cylinder head 1 toward the water jacket 3.

In other words, when the coolant flows in through each coolant inlet 3*a* provided in the cylinder head 1, almost all of the coolant flows in a section of the water jacket 3 of the cylinder head 1 constituting each cylinder, through structures of the partition walls, and through the passageway 19. Accordingly, a portion of the coolant also flows in a neighboring section of the water jacket 3.

Accordingly, the coolant is induced to flow intensively for each section of the water jacket 3 in the cylinder head 1, thereby preventing a local increase in temperature of the exhaust ports. Further, the coolant having flowed in each section of the water jacket 3 of the cylinder head 1 flows to a neighboring section of the water jacket 3 through the passageway 19, thereby preventing congestion of the flow of the coolant and improving cooling performance of the cylinder head 1.

In this embodiment, the end portion of the first partition wall 15 may be formed in a shape being bent toward a coolant outlet 3*e* of the coolant passage.

In other words, in the process where the coolant having flowed in the water jacket 3 of the cylinder head 1 flows toward the coolant outlet 3*e*, the coolant is guided along the shape of the end portion of the bent shaped first partition wall 15, thereby reducing resistance to flow velocity of the coolant. Accordingly, it is possible to effectively prevent an increase in temperature of the exhaust ports through increasing flow velocity of the coolant.

In this embodiment, the coolant passage may include a first passage 3*b*.

In this embodiment, referring to FIGS. 1 and 2, the coolant may flow in the cylinder head 1 through the coolant inlet 3*a*.

For example, the coolant inlet 3*a* may be configured to allow the coolant to flow in from a lower portion of the cylinder head 1. Further, the first passage 3*b* may be configured to allow the coolant having flowed in through the coolant inlet 3*a* to flow in and around end portions of the exhaust port holes 5, which are connected to the combustion chamber 11. In this embodiment, a first end of the first passage is connected to the coolant inlet 3*a*.

For example, in this embodiment the first passage 3*b* may branch from the coolant inlet 3*a* and be configured to surround the exhaust port holes 5, thereby allowing the coolant to flow passed and around the exhaust port holes 5.

In this embodiment, the first passage 3*b* may be provided at the lower portion of the cylinder head 1 such that the coolant flows from the coolant inlet 3*a* toward the exhaust port holes 5.

In other words, since all of the cool coolant flowing in through each coolant inlet 3*a* of each section of the cylinder head 1 is induced to flow intensively in the first passage 3*b*, the flow velocity of the coolant passing around the exhaust port holes 5 increases and the metal surface temperature of the exhaust ports is lowered, thereby removing any hot spots produced by a local increase in temperature. Thus, it is possible to improve fuel efficiency by lowering the risk of knocking.

Further, in this embodiment, the coolant passage of the present disclosure may include a second passage 3*c* formed to cross from the end portion of the first passage 3*b* to an upper portion of the combustion chamber 11.

For example, the second passage 3*c* may be configured such that a first end thereof is connected to a second end of the first passage 3*b*, wherein the second passage may be configured to surround a spark plug hole 9 provided in the cylinder head 1 such that the coolant flows passed and around the spark plug hole 9.

Further, in this embodiment, the second passage 3*c* may be configured to surround peripheries of end portions of the intake port holes 7, which communicate with the combustion chamber 11 such that the coolant flows passed and around the intake port holes 7.

In this embodiment, the second passage 3*c* may be provided at the lower portion of the cylinder head 1 such that the coolant flows from the exhaust port holes 5 toward the intake port holes 7.

In other words, the coolant having passed through the first passage 3*b* cools the high temperature of the upper portion of the combustion chamber 11 while passing therearound. Therefore, in the cylinder head 1, any hot spots produced by a local increase in temperature are removed, thus improving fuel efficiency by lowering the risk of knocking.

Further, in this embodiment, the coolant passage of the present disclosure may include a third passage 3*d* extending from an end portion of the second passage 3*c* to a periphery of an oil jacket 13 provided in the cylinder head 1.

In this embodiment, for example, a first end of the third passage 3*d* may be configured to be connected to a second end of the second passage 3*c*.

In particular, the third passage 3*d* may be configured to branch at a location around the oil jacket 13. In this embodiment, the third passage 3*d* may be provided at an upper portion of the cylinder head 1 such that the coolant flows from a circumference of the intake port holes 7 toward a circumference of the exhaust port holes 5.

In other words, the coolant having absorbed heat while passing around the exhaust port holes 5 and the combustion chamber 11 is processed by heat exchange with oil while passing around the oil jacket 13, thereby reducing friction loss by reducing oil warm-up time and improving fuel efficiency.

Further, in this embodiment, the coolant passage of the present disclosure may include a coolant outlet 3*e* that is connected to the third passage 3*d* and thus discharges the coolant therefrom.

For example, a second end of the third passage 3*d* may be configured to be connected to the coolant outlet 3*e*, wherein the coolant outlet 3*e* may be provided at a location where the branched third passages 3*d* join each other.

In this embodiment, the coolant outlet 3*e* may be provided at a side of the upper portion of the cylinder head 1.

As described above, the present disclosure according to one embodiment is configured such that all the cool coolant flowing in the water jacket 3 of the cylinder head 1 passes around the exhaust ports, the metal surface temperature of which is the highest part of the cylinder head 1. The flow velocity of the coolant passing around the exhaust ports is increased and thus lowers the metal surface temperature of the exhaust ports. Accordingly, by equalizing metal surface temperatures of the combustion chamber 11 of the cylinder head 1, any hot spots produced by local increases in temperature are removed, thereby improving fuel efficiency by lowering the risk of knocking.

Although embodiments of the present disclosure have been described for illustrative purposes, those of ordinary skill in the art will appreciate that various modifications, additions and substitutions are possible, without departing from the scope and spirit of the appended claims.

What is claimed is:

1. A water jacket for a cylinder head, the water jacket comprising: a coolant inlet provided near exhaust port holes of a cylinder head to concentrate a flow of a coolant to the coolant inlet; a coolant passage configured to allow the coolant flowing in through the coolant inlet to flow around the exhaust port holes; a first partition wall provided between exhaust port holes of a cylinder and neighboring exhaust port holes of a neighboring cylinder; a second partition wall provided between intake port holes of the cylinder and neighboring intake port holes of the neighboring cylinder; and a passageway communicating with the coolant passage, the passageway provided between an end portion of the first partition wall and an end portion of the second partition wall such that the coolant flows through the passageway, wherein the first and second partition walls begin along a border of the cylinder head and extend towards each other and towards a middle of the water jacket in which the passageway is only a space in between the two partition walls and is in the middle of the cylinder head; and wherein the end portion of the first partition wall is formed in a shape being bent toward a coolant outlet of the coolant passage.

2. The water jacket of claim 1, wherein the coolant passage includes:

a first passage configured to allow the coolant having flowed in through the coolant inlet to flow around end portions of the exhaust port holes, the end portions of the exhaust port holes being connected to the combustion chamber.

3. The water jacket of claim 2, wherein the first passage is configured to branch from the coolant inlet to surround each of the exhaust port holes.

4. The water jacket of claim 2, wherein the coolant passage further includes:

a second passage configured to cross from an end portion of the first passage to an upper portion of the combustion chamber.

5. The water jacket of claim 4, wherein the second passage is configured to surround a spark plug hole provided in the cylinder head.

6. The water jacket of claim 4, wherein the second passage is configured to surround peripheries of end portions of the intake port holes, the end portions of the intake port holes being connected to the combustion chamber.

7. The water jacket of claim 4, wherein the coolant passage further includes:

a third passage extending from the second passage to a periphery of an oil jacket provided in the cylinder head; and a coolant outlet connected to the third passage to allow the coolant to be discharged therefrom.

8. The water jacket of claim 7, wherein the third passage is configured to branch at a location around the oil jacket; and the coolant outlet is provided at a location where the branched third passages join each other.

9. The water jacket of claim 7, wherein the coolant inlet is configured to allow the coolant to flow in from a lower portion of the cylinder head;

the first passage is provided at the lower portion of the cylinder head and configured to allow the coolant to flow from the coolant inlet toward the exhaust port holes;

the second passage is provided at the lower portion of the cylinder head and configured to allow the coolant to flow from the exhaust port holes toward the intake port holes;

the third passage is provided at an upper portion of the cylinder head and configured to allow the coolant to flow from a circumference of the intake port holes toward a circumference of the exhaust port holes; and the coolant outlet is configured to allow the coolant to be discharged from the upper portion of the cylinder head.

* * * * *